US006880821B2

(12) United States Patent
Park

(10) Patent No.: US 6,880,821 B2
(45) Date of Patent: Apr. 19, 2005

(54) PAPER FEEDING CASSETTE FOR IMAGE FORMING APPARATUS

(75) Inventor: Gyeong-ho Park, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 169 days.

(21) Appl. No.: 10/298,584

(22) Filed: Nov. 19, 2002

(65) Prior Publication Data

US 2003/0132570 A1 Jul. 17, 2003

(30) Foreign Application Priority Data

Jan. 15, 2002 (KR) ..... 2002-2366

(51) Int. Cl.[7] ..... B65H 3/52

(52) U.S. Cl. ..... 271/121; 271/19; 271/21; 271/109; 271/124

(58) Field of Search ..... 271/19, 21, 109, 271/121, 124

(56) References Cited

U.S. PATENT DOCUMENTS

| | | | | | |
|---|---|---|---|---|---|
| 5,277,417 | A | * | 1/1994 | Moritake et al. | 271/121 |
| 5,823,524 | A | * | 10/1998 | Kawada | 271/124 |
| 5,895,040 | A | * | 4/1999 | Oleksa et al. | 271/124 |
| 5,899,450 | A | * | 5/1999 | Gettelfinger et al. | 271/121 |
| 6,279,897 | B1 | * | 8/2001 | Richards | 271/121 |
| 2002/0060396 | A1 | * | 5/2002 | Tananka | 271/121 |

* cited by examiner

*Primary Examiner*—Donald P. Walsh
*Assistant Examiner*—Kenneth W Bower
(74) *Attorney, Agent, or Firm*—Staas & Halsey LLP

(57) ABSTRACT

A paper feeding cassette for an image forming apparatus includes an inclined supporter including an inclined plate fixedly disposed in a cassette body and a support plate for reciprocating, a separation guide including a fixing guide fixedly supported on the inclined plate and a moving guide movably supported on the support plate, and a reciprocating unit reciprocating the support plate. Accordingly, the moving guide selectively comes into contact with a sheet such that a friction resistance generated at a front end of the sheet varies in a degree in accordance with a type of the sheet.

8 Claims, 6 Drawing Sheets

PAPER FEEDING CASSETTE FOR IMAGE FORMING APPARATUS

CROSS-REFERENCE TO RELATED APPLICATIONS

This application claims the benefit of Korean Patent Application No. 2002-2366, filed Jan. 15, 2002, in the Korean Intellectual Property Office, the disclosure of which is incorporated herein by reference.

BACKGROUND OF THE INVENTION

1. Field of the Invention

The present invention relates to a paper feeding cassette for an image forming apparatus, and more particularly, to a paper feeding cassette removably mounted in an image forming apparatus to contain sheets of paper to be printed therein and supply the sheets to an image forming apparatus body one by one.

2. Description of the Related Art

Referring to FIG. 1, an image forming apparatus, such as a photocopier, a laser printer, a facsimile, and a multi-function device, has a paper feeding cassette 100 in which sheets of paper to be supplied into an image forming apparatus body are stacked. Generally, the paper feeding cassette 100 is removably mounted in the image forming apparatus body. The sheets stacked in the paper feeding cassette 100 are supplied to the image forming apparatus body, one by one, by a pick-up unit.

Referring to FIGS. 2 and 3, the paper feeding cassette 100 includes a cassette body 110, an inclined supporter 130 disposed inside the cassette body 110 at a predetermined slope with respect to an uppermost sheet P, and a separation guide 120 being supported on the inclined supporter 130.

In the above construction, a pickup roller 140 rotates to be in contact with the uppermost sheet P stacked in the paper feeding cassette 100 and pushes up the uppermost sheet P in a direction of "A". Then, a front end of the sheet P comes into contact with the separation guide 120. At this point, there is a roughness on a surface of the separation guide 120 to which the sheet P contacts. Accordingly, the sheet P is separated one by one due to a friction resistance that is generated when the uppermost sheet P comes into contact with the surface of the separation guide 120, and when the sheet P is slidably picked-up.

Recently, the image forming apparatus has been improved to be capable of performing a printing operation using various types of the sheet P. Accordingly, the paper feeding cassette 100 is available to accommodate the various types of the sheet P.

However, the surface of the separation guide 120 to be in contact with the sheet P is made of a material having a predetermined surface roughness, and the separation guide 120 is fixedly disposed in the cassette body 110. Accordingly, the sheet P is picked-up by the pickup roller 140 with the same friction resistance regardless of the type of the sheet P.

Accordingly, if the separation guide 120 is made of material having a high surface roughness, it is effective in separating a thin sheet P one by one. However, in the same case, the separation guide 120 has a difficulty separating a thick sheet P due to an increased friction resistance, which is attributed to a self-weight of the thick sheet P. Thus, there are problems that the thick sheet P is not picked-up and is jammed in the cassette body 110.

On the other hand, if the separation guide 120 is made of another material having a low surface roughness, it has the effectiveness in separating and picking up the thick sheet P one by one owing to the decreased friction resistance. However, in the same case, since the friction resistance is not generated sufficiently for the separation guide 120 to separate the thin sheet P one by one, there is a problem that the thin sheet P is fed out in an overlapping relationship with other sheets P.

SUMMARY OF THE INVENTION

In order to solve the above and other problems in the related art, it is an object to provide a paper feeding cassette having a plurality of paper separation guides able to separate various types of paper one by one from a paper cassette.

Additional objects and advantageous of the invention will be set forth in part in the description which follows and, in part, will be obvious from the description, or may be learned by practice of the invention.

In order to achieve the above and other objects, a paper feeding cassette for an image forming apparatus according to an embodiment of the present invention includes a separation guide disposed in the cassette body containing sheets therein in plural numbers and comes into contact with a front end of the sheet being picked-up such that there occurs a predetermined friction resistance at a contacting area of the separation guide and the sheet. At least one separation guide is disposed to be able to contact selectively the front end of the sheet in accordance with a type of the sheet.

Accordingly, the friction resistance between the picked-up sheet and the separation guide can vary in degree. Therefore, it is possible to separate the sheets one by one regardless of the type of the sheets stacked in the cassette body and supply the sheet to an image forming apparatus body of the image forming apparatus.

According to another embodiment of the present invention, the paper feeding cassette for the image forming apparatus includes a cassette body containing the sheets therein, an inclined plate fixedly disposed in the cassette body to come into contact with a picked-up sheet, at least one fixing guide fixedly disposed in the cassette body and supported on the inclined plate, at least one moving guide movably disposed at the inclined plate to move toward and away from a contact line where the fixing guide contacts the sheet, and a reciprocating unit linearly reciprocating the moving guide.

The reciprocating unit includes a support plate movably disposed within a space formed between a rear surface of the fixing guide and a sidewall of the cassette body to support the moving guide, a guide portion movably supporting the support plate in a sliding manner, a cam member rotatably disposed within the space to contact a rear surface of the support plate to reciprocate the support plate, and a resilient pressing member resiliently pressing one of the support plate and the cam member in a direction of a contact point of the support plate and the cam member.

According to an aspect of the present invention, the inclined plate is provided with at least one opening. It is possible that the moving guide selectively moves with respect to the contact line between the sheet and the fixing guide through the opening in accordance with a reciprocal movement of the support plate.

According to another aspect of the present invention, the cam member is disposed on a rotary shaft disposed across the space, and the rotary shaft is rotated by a driving unit.

According to another aspect of the present invention, the driving unit is a rotary lever disposed at an end of the rotary shaft extended from the sidewall of the cassette body or an electromotive motor disposed inside the cassette body to be connected with the rotary shaft to transmit a rotation driving force to the rotary shaft.

According to another aspect of the present invention, the resilient pressing member is an extension spring disposed between the support plate and the sidewall of the body to pull the support plate toward the sidewall, or a compression spring disposed between the support plate and the inclined plate to push the support plate toward the sidewall of the cassette body.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
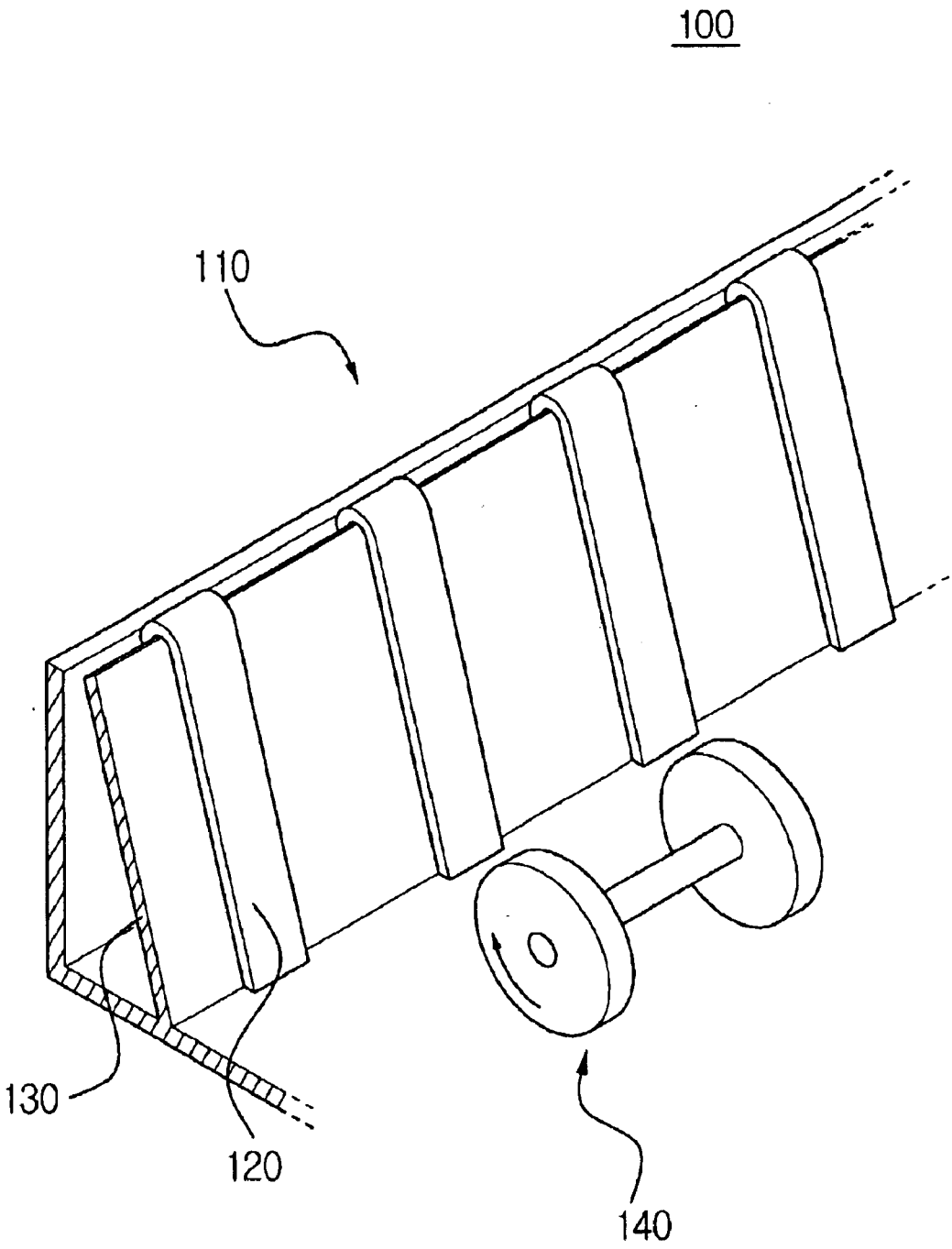
FIG. 1 (PRIOR ART)
FIG. 1 is a perspective view showing an interior of a paper feeding cassette for a conventional image forming apparatus.
Figure 2:
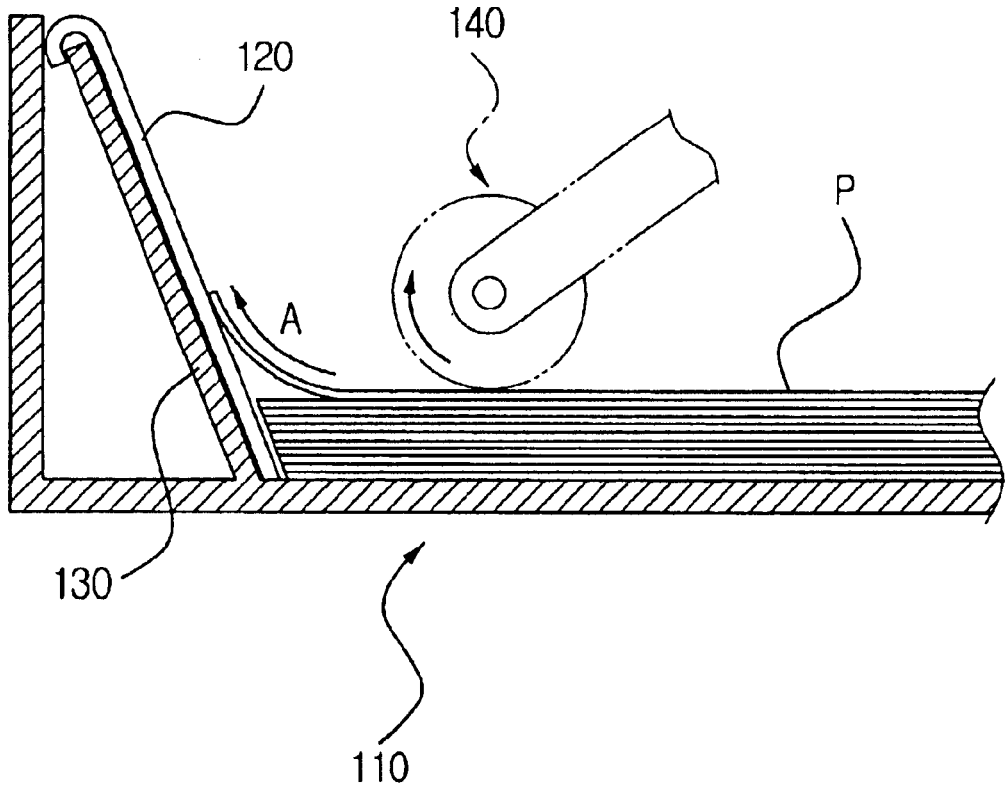
FIG.2 (PRIOR ART)
FIG. 2 is a side section view schematically showing the paper feeding cassette of FIG. 1.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Hereinafter, embodiments of the present invention will be described in greater detail with reference to the accompanying drawings.

Figure 3:
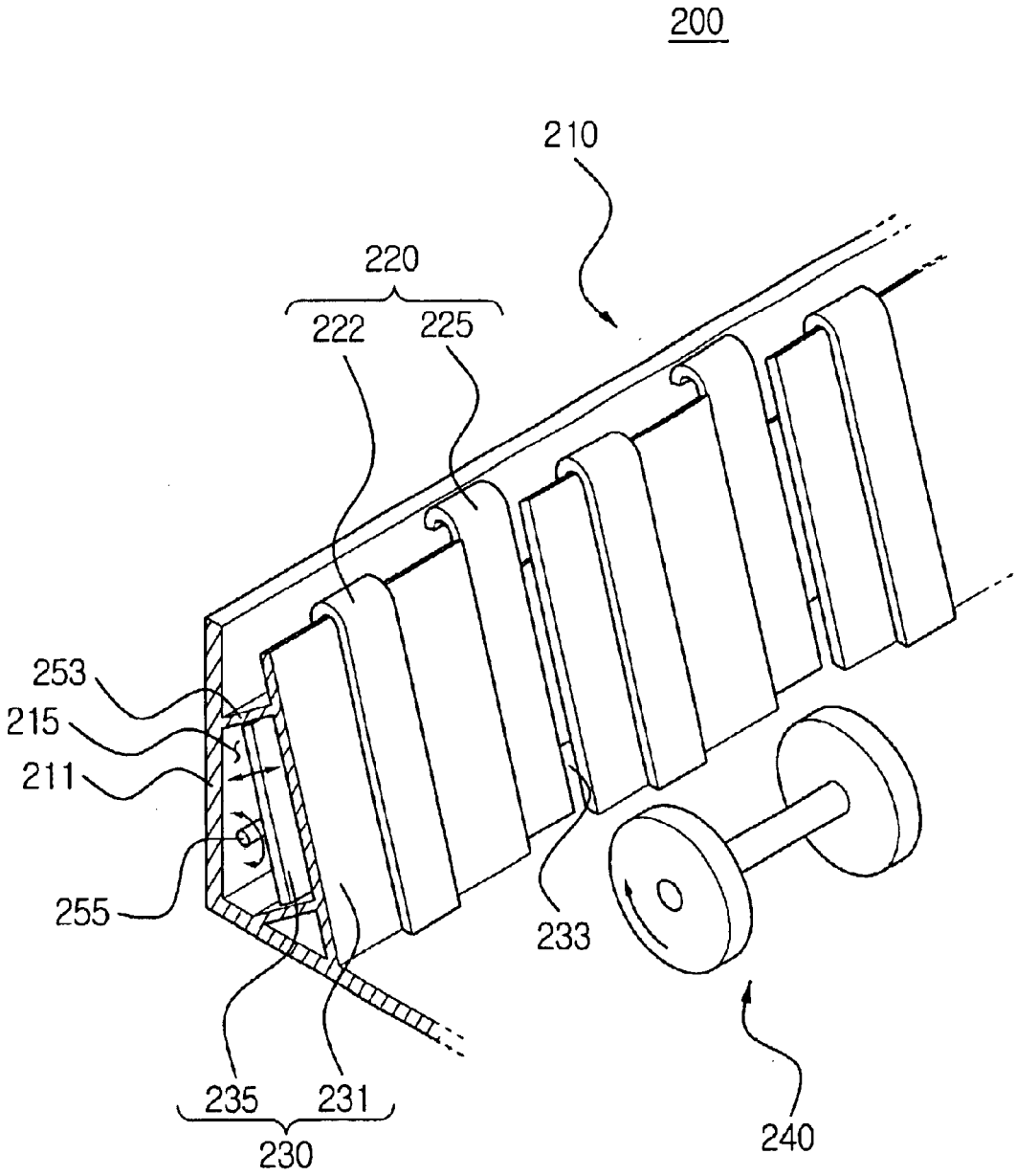
FIG. 3 is a perspective view showing an interior of a paper feeding cassette in accordance with an embodiment of the present invention.

Referring to FIG. 3, a paper feeding cassette 200 for an image forming apparatus according to an embodiment of the present invention includes a cassette body 210 having a containing space to contain sheets therein, an inclined supporter 230 disposed in the cassette body 210, and a separation guide 220 supported on the inclined supporter 230. The cassette body 210 is removably mounted in an image forming apparatus body (not shown) and is provided with a pickup roller 240 picking-up the sheets stacked in the cassette body 210 and supplying the sheets to the image forming apparatus body.

The separation guide 220 is disposed in the cassette body 210 in plural numbers, and comes into contact with a front end of a sheet being picked-up by the pickup roller 240 such that there occurs a predetermined friction resistance at a contacting area of the separation guide 220 and the sheet. At least one separation guide 220 is disposed to be able to contact selectively the front end of the sheet in accordance with a type of the sheet. That is, the separation guide 220 includes a fixing guide 222 and a moving guide 225, wherein the fixing guide 222 is fixedly disposed at the cassette body 210, and the moving guide 225 is movably disposed at the cassette body 210. Accordingly, the moving guide 225 selectively moves toward or away from a contact line where the front end of the picked-up sheet contacts the fixing guide 222.

The separation guide 220 as constructed above is supported on the inclined supporter 230 which is disposed in the cassette body 210 at a predetermined slope with respect to the sheet. The inclined supporter 230 includes an inclined plate 231 and a support plate 235 which support the fixing guide 222 and the moving guide 225, respectively. The inclined plate 231 is fixed to the cassette body 210. The support plate 235 reciprocates linearly within a space 215 that is formed between a sidewall 211 of the cassette body 210 and the inclined plate 231. The sidewall 211 is disposed at a rear side of the inclined plate 231.

Here, the inclined plate 231 is provided with at least one opening 233. The opening 233 is a path through which the moving guide 225 moves toward and back with respect to the front end of the sheet or the contact line in accordance with a reciprocal movement of the support plate 235. Provided in this embodiment are a plurality of inclined plates 231, which are spaced from each other by a predetermined distance. Accordingly, the opening 233 is regularly formed by a gap 233 between the inclined plates 231*a* or between the fixing guides 222.

Figure 4:
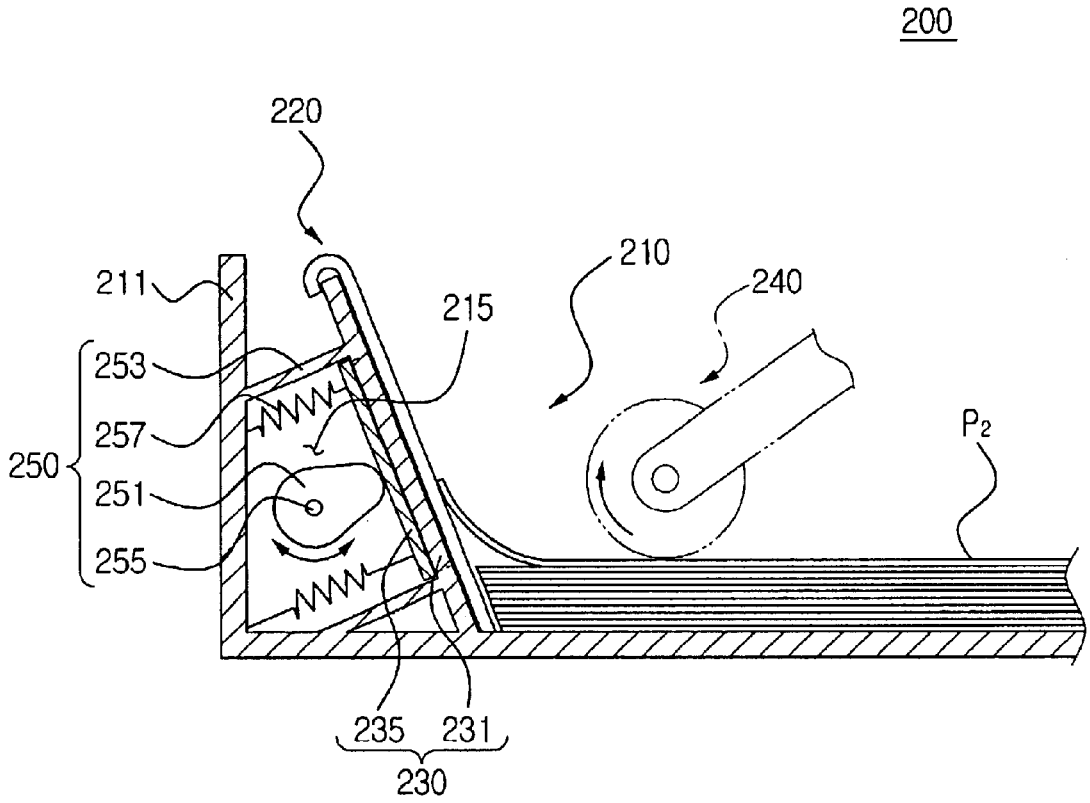
FIGS. 4 and 5 are side section views schematically showing a moving guide and a reciprocating unit of the paper feeding cassette of FIG. 3.

As shown in FIG. 4, the moving guide 225 reciprocates linearly by a reciprocating unit 250 including the support plate 235 supporting the moving guide 225. At this point, the reciprocating unit 250 includes a guide portion 253 for guiding the support plate 235 to slidably move within the space 215, and a cam member 251 rotatably mounted in the cassette body 210 and disposed in the space 215, a side of the cam member 251 contacting a rear surface of the support plate 235. The cam member 251 rotates and controls the support plate 235 to reciprocate linearly within the space 215 along the guide portion 253.

Figure 6:
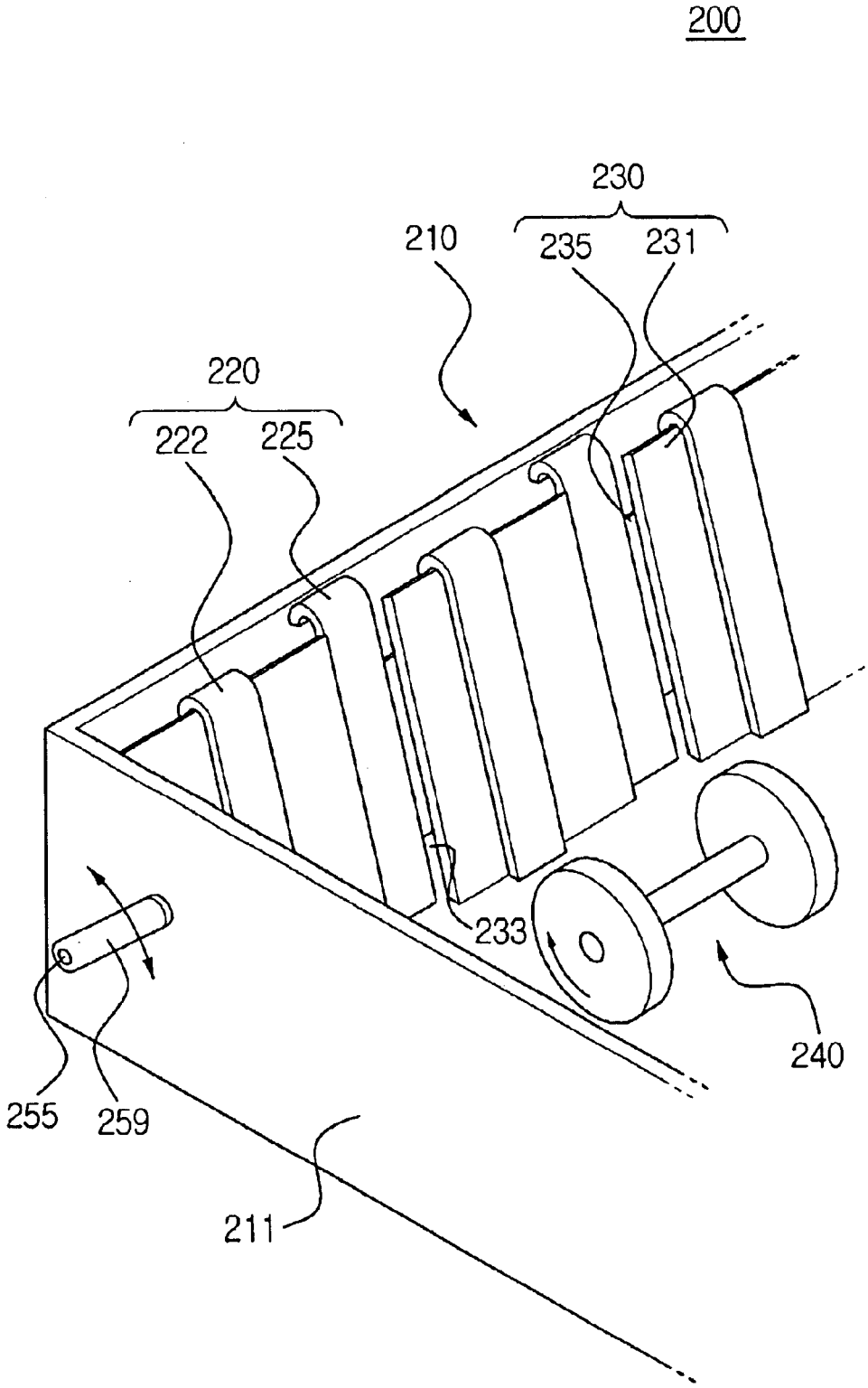
FIG. 6 is a perspective view schematically showing an appearance of the paper feeding cassette of FIG. 3.

Furthermore, the reciprocating unit 250 includes a driving unit rotating the cam member 251 and a rotary shaft 255 transmitting a rotation driving force from the driving unit to the cam member 251. At this point, the rotary shaft 255 is disposed across the space 215 along the rear surface of the support plate 235, and the cam member 51 is disposed on the rotary shaft 255. Also, as shown in FIG. 6, the driving unit rotatably driving the rotary shaft 255 includes a rotary lever 259 disposed at an end of the rotary shaft 255 extended from the sidewall 211 of the cassette body 210. Accordingly, a user manipulates the rotary lever 259 to rotate the cam member 251 in accordance with the type of the sheet stacked in the paper feeding cassette 200, thereby allowing the moving guide 225 to come into contact with or be separated from the front end of the picked-up sheet.

As shown in FIG. 4, the reciprocating unit 250 further includes a resilient recovering unit allowing the moving guide 225, which advances to contact the front end of the sheet by the rotation of the cam member 251, to separate automatically the front end of a thin sheet P2. A resilient pressing member 257 is used as the resilient recovering unit and disposed inside the space 215 to press resiliently one of the support plate 235 and the cam member 251 in a direction of a contact point of the support plate 235 and the cam member 251. At this point, the resilient pressing member 257 includes a coil spring 257 connecting the support plate 235 to the sidewall of the cassette body 210. The coil spring 257 functions as a tension spring to pull the support plate 235 toward the sidewall 211. Accordingly, the support plate 235 maintains a contacting condition with the side of the cam member 251 regardless of a position of the cam member 251, thereby reciprocating linearly along the guide portion 253 with the cam member 251 when the cam member 251 rotates.

The paper feeding cassette 200 as constructed above is not limited to this embodiment. For example, unlike the above embodiment in which a single support plate 235 is provided with a plurality of the moving guides 225, the support plate 235 may be provided in plural numbers to correspond to the respective moving guides 225. In this case, the cam member 251 is provided on the rotary shaft 255 in plural numbers to correspond to the respective support plates 235 and, accordingly, the guide portion 253 and the resilient pressing member 257 are also provided in plural numbers to correspond to the respect support plates 235.

Also, the rotary shaft 255 is rotatably driven by being connected to another driving unit instead of the rotary lever 259, wherein the another driving unit may be an electromotive motor disposed inside the image forming apparatus (not shown) for an overall driving of mechanisms of the image forming apparatus body. Accordingly, after a paper type detecting signal is input to a controller (not shown) by a user's selection or a predetermined paper type detecting sensor, the controller controls the another driving unit to reciprocate automatically such that the support plate 235 reciprocates.

Also, various modifications are possible as well. For example, the resilient pressing member 257 may be a compression spring that is disposed to connect the support plate 235 to the inclined plate 231, or a compression spring resiliently compressing the cam member 251 toward the support plates 235.

Hereinafter, an operation of the paper feeding cassette of the image forming apparatus according to another embodiment of the present invention will be described in detail with reference to the accompanying drawings.

Figure 5:
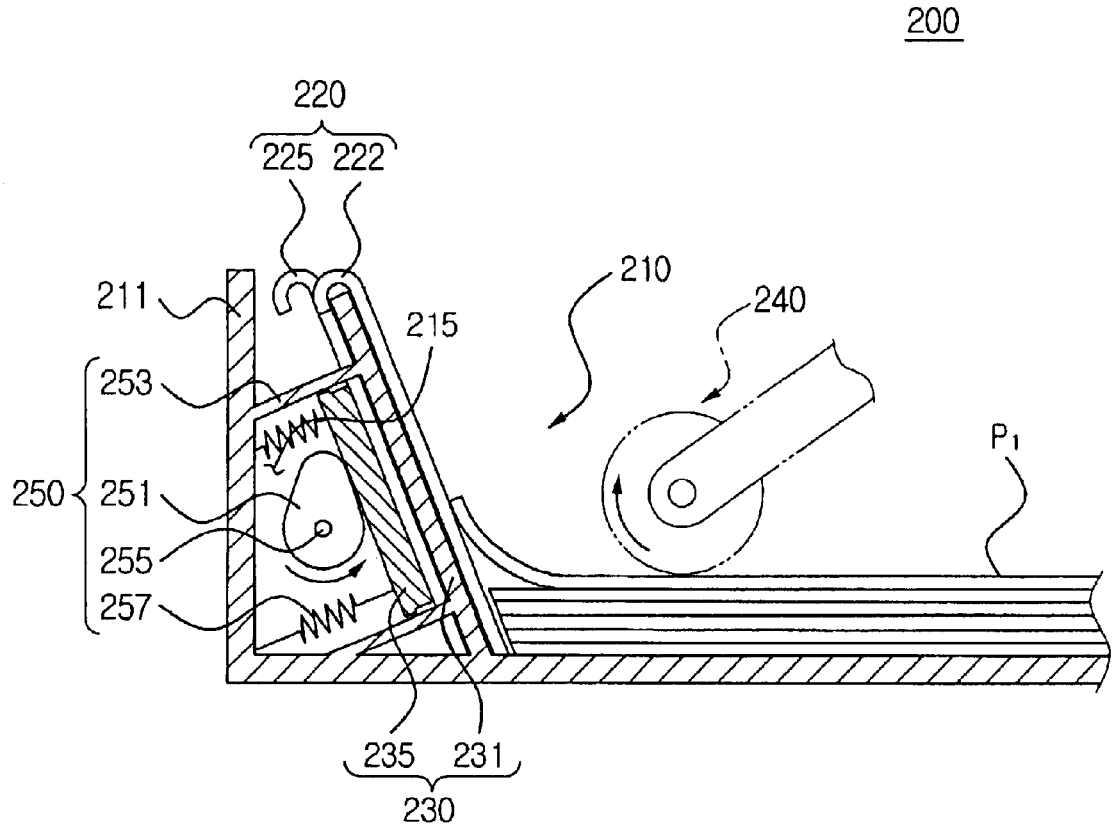

As shown in FIG. 5, if a thick sheet P1 is stacked in the cassette body 210, the user manipulates the rotary lever 259 to move the support plate 235 toward an inner side of the space 215. Then, the moving guide 225 moves back toward the space 215 through the opening 233 not to contact the thick sheet P1 such that a friction resistance between the separation guide 220 and the picked-up paper P1 becomes minimized. In this state, the pick-up roller 240 rotates to separate the sheet P1 one by one from the plurality of sheets P stacked in the cassette body 210 and supply the sheet to the image forming apparatus body (not shown).

Meanwhile, as shown in FIG. 4, if the thin sheet P2 thinner than the thick sheet P1 in FIG. 4 is stacked in the cassette body 210, the friction resistance occurred in the above state where the moving guide 225 moves away from the inclined plate 231 toward the space 215 and where only the fixed guide contacts the thin sheet P2, is not sufficient to separate the thinner sheet P2 one by one. Therefore, in order to increase the friction resistance, the user manipulates the rotary lever 259 to move linearly the moving guide 225 toward the front end of the thinner sheet P2. Then, the moving guide 225 and the fixing guide 222 simultaneously come into contact with the thin sheet P2 such that there occurs a higher degree of the friction resistance than that generated in FIG. 4. Accordingly, the thin sheet P2 is easily picked-up and separated one by one.

Meanwhile, although this embodiment depicts that the fixing guide 222 and the moving guide 225 have the same degree of surface roughness, it is understood that the invention is not limited thereto. That is, the various modifications are possible. For example, the moving guide 225 may have a higher surface roughness than the fixing guide 225 and vice versa.

The paper feeding cassette 200 as described above according to the present invention is provided with the separation guide 220 generating the friction resistance by contacting the front end of the sheet P1 or P2, wherein the separation guide 220 includes the moving guide 225 disposed to contact selectively the sheet P1 or P2.

According to the above construction, the moving guide 225 is manipulated to reciprocate linearly in accordance with the type of the sheet P1 or P2 such that the friction resistance between the sheet P1 or P2 and the separation guide 220 varies in a degree. Accordingly, a variation in the degree of the friction resistance according to the type of the sheet P1 or P2 makes it easy to supply the sheet P1 or P2 one by one to the image forming apparatus body. Especially, in a case of the thick sheet P1, the cassette body 210 is prevented from jamming.

Although a few preferred embodiments of the present invention have been described, it will be understood by those skilled in the art that the present invention should not be limited to the described preferred embodiments and that changes may be made in this embodiment without departing from the principles and sprit of the invention, the scope of which is defined in the claims and their equivalents.

What is claimed is:

1. A paper feeding cassette for an image forming apparatus, comprising:

a cassette body containing a sheet therein;

an inclined plate fixedly disposed in the cassette body to come into contact with the sheet;

a fixing guide fixedly disposed in the cassette body and supported on the inclined plate to contact the sheet;

a moving guide movably disposed at the inclined plate to move toward and away from a contact line where the fixing guide contacts the sheet; and a reciprocating unit linearly reciprocating the moving guide.

2. The paper feeding cassette of claim 1, wherein the cassette body comprises a space formed between a rear surface of the fixing guide and a sidewall of the cassette body, and the reciprocating unit comprises:

a support plate movably disposed within the space to support the moving guide;

a guide portion movably supporting the support plate in a sliding manner;

a cam member rotatably disposed within the space to contact a rear surface of the support plate to reciprocate the support plate; and a resilient pressing member resiliently pressing one of the support plate and the cam member in a direction of a contact point of the support plate and the cam member.

3. The paper feeding cassette of claim 2, wherein the inclined plate comprises an opening, and the moving guide selectively moves with respect to the contact line through the opening in accordance with a reciprocal movement of the support plate.

4. The paper feeding cassette of claim 2, wherein the reciprocating unit comprises a driving unit and a rotary shaft disposed across the space to be rotated by the driving unit, and the cam member is disposed on the rotary shaft.

5. The paper feeding cassette of claim 4, wherein the driving unit comprises a rotary lever disposed at an end of the rotary shaft extended from the sidewall of the cassette body.

6. The paper feeding cassette of claim 4, wherein the driving unit comprises an electromotive motor disposed inside the cassette body being connected with the rotary shaft to transmit a rotation driving force to the rotary shaft.

7. The paper feeding cassette of claim 2, wherein the resilient pressing member comprises an extension spring disposed between the support plate and the sidewall of the body to pull the support plate toward the sidewall.

8. The paper feeding cassette of claim 2, wherein the resilient pressing member comprises a compression spring disposed between the support plate and the inclined plate to pull the support plate toward the sidewall of the cassette body.

* * * * *

UNITED STATES PATENT AND TRADEMARK OFFICE

CERTIFICATE OF CORRECTION

PATENT NO. : 6,880,821 B2
DATED : April 19, 2005
INVENTOR(S) : Gyeong-ho Park

It is certified that error appears in the above-identified patent and that said Letters Patent is hereby corrected as shown below:

Title page,
Item [75], Inventor, change "Suwon" to -- Suwon-si --.

Signed and Sealed this

Fourteenth Day of March, 2006

JON W. DUDAS
*Director of the United States Patent and Trademark Office*